US005795402A

United States Patent [19]

Hargett, Sr. et al.

[11] Patent Number: 5,795,402

[45] Date of Patent: Aug. 18, 1998

[54] APPARATUS AND METHOD FOR REMOVAL OF PARAFFIN DEPOSITS IN PIPELINE SYSTEMS

[76] Inventors: Daniel Hargett, Sr., 116 Shannon Rd., Lafayette, La. 70503; Ernest D. Casey, 627 Sancroft Ct., Katy, Tex. 77450; Ian D. Casey, 2127 Foundary Dr., Katy, Tex. 77493

[21] Appl. No.: 685,693

[22] Filed: Jul. 24, 1996

Related U.S. Application Data

[60] Provisional application No. 60/001,431 Jul. 25, 195.

[51] Int. Cl.[6] ..... B08B 9/04

[52] U.S. Cl. ..... 134/8; 134/22.12; 134/22.13; 15/104.061; 15/104.063; 15/3.5

[58] Field of Search ..... 134/8, 22.12, 22.13, 134/26; 15/104.061, 3.5, 104.12, 104.063

[56] References Cited

U.S. PATENT DOCUMENTS

| | | | |
|---|---|---|---|
| 1,806,478 | 5/1931 | Long | 15/104.061 |
| 2,117,648 | 5/1938 | Bottorf | 134/8 |
| 3,900,912 | 8/1975 | Lenz et al. | 15/104.061 |
| 3,939,519 | 2/1976 | Muirhead | 15/104.061 |
| 4,411,039 | 10/1983 | Timmins et al. | 134/8 |
| 4,498,932 | 2/1985 | Kruka | 134/8 |
| 4,603,449 | 8/1986 | Knapp | 15/104.061 |

*Primary Examiner*—Harold Y. Pyon
*Assistant Examiner*—Saeed Chaudhry
*Attorney, Agent, or Firm*—Pravel, Hewitt, Kimball & Krieger

[57] ABSTRACT

An apparatus and a method for cleaning the inner wall of a pipeline, which includes providing a pig component, of the type having a pig body, a plurality of spacers around the pig body, the spacers making contact with an inner surface of the pipeline wall, a forward end of the pig having a plurality of pressure nozzles positioned thereon for allowing fluid under pressure to flow therefrom onto the inner wall of the pipeline; a bore through the pig body extending from an opening in a rear end of the pig, to the forward end of the pig; a valving member on the forward end of the pig for moving to the open position to allow the fluid to flow to the pressure nozzles when sufficient fluid pressure is placed on the valving member; providing a fluid under pressure, such as water or chemicals, to the rear and front of the pig, the fluid forcing the pig to move forward under pressure; encountering an obstruction, such as paraffin, formed along the inner wall of the pipeline fo such amount to hinder the forward movement of the pig through the pipeline; increasing the pressure on the pig sufficient to moving the valving member to the open position for allowing the fluid under pressure to spray from the pressure nozzles against the paraffin obstruction sufficiently to dislodge the paraffin from the wall of the pipeline; resuming the speed of the pig after the paraffin obstruction has been dislodged so that the pig forces the paraffin through and out of the end of the pipeline.

13 Claims, 4 Drawing Sheets

APPARATUS AND METHOD FOR REMOVAL OF PARAFFIN DEPOSITS IN PIPELINE SYSTEMS

This application is based upon provisioned application Ser. No. 60/001,431, filed on Jul. 25, 1995, entitled "REMOVAL OF WAX DEPOSITS IN PIPELINE SYSTEMS", by the same inventors, incorporated herein by reference thereto.

SPECIFICATION

BACKGROUND OF THE INVENTION

1. Field of the Invention:

The apparatus and system of the present invention relates to pipeline systems. More particularly, the present invention relates to a system and apparatus for cleaning deposits from the walls of pipeline systems, in particular, deposits of paraffin which accumulate on the wall of the pipeline during use.

2. General Background:

Pipeline systems are utilized throughout the world in order to transport oil, gas, water, and chemical slurries, between distant points. During the transport of certain hydrocarbons and chemicals, there is often a build-up of materials on the inner wall of the pipeline, the most universal material being a type of paraffin which accumulates from hydrocarbon pipelines, particularly in the area of offshore gathering in transmission pipelines. For example, crude oil, which has been obtained from beneath the earth's surface, through drilling, will be routed through a pipeline from the wellhead at a high temperature often in excess of 250° Fahrenheit. As the crude oil flows through the offshore pipeline, to its destination, a cooling process naturally occurs. Paraffin, also known as aspheltines, would tend to drop out of the crude oil as the oil cools, usually in the neighborhood of below 140° F. As the paraffin builds upon the wall of the pipeline, because of cooling, it tends to form an insulation against the low temperature of the wall of the pipeline. This insulation effect extends the area of wax formation, and therefore the flowbore of the pipeline becomes restricted by the wax over an extended area, and not just confined to one small area, due to this insulation effect created by the paraffin build-up.

As the paraffin deposits increase, there is a resultant loss of flow and/or increased energy required to maintain the flow of the crude oil through the pipeline to its destination. The methods currently used in order to reduce the build-up of contaminants are varied. The most common is to batch solvents, which is rarely effective and extremely costly in time, due to the revenues lost by the restricted oil flow, and the high cost of the solvents involved.

Other methods include the use of undersized Poly Pigs which may contribute to a line blockage or become disintegrated. One extremely high cost partial solution is to "Hot Tap" the pipeline at close intervals and flush with hot oil. This attempts to be effective against the paraffin build-up. A further method is to batch "Moth Balls" which is a method used very little due to it being non-effective. At this time, one solution known in the art has been carried out by the Baker Chemical Performance Company, which, together with Shell Developments, has designed a chemical process known as "Nsitu". The composition is comprised of two or more components which include Hydrochloric acid and Ammonia. Other solutions include additives i.e. iron, sequestering agents and corrosion inhibitors. Baker Hughes has been successful in downhole applications but their success has been limited for the removal of wax in pipeline systems. This is due to the line of the exothermic chemical reaction, together with the generation of nitrogen gas and brine (salt water) when the system is in use. Following the batch containing anhydrous ammonia, a further batch of xylene may be introduced in order to eliminate the possibility of crystallization. In another context, the pig may be run with a solution of xylene. This chemical coupled with the pig's jetting action may be used to remove softer deposits.

Therefore, there is a need in the art for a system for cleaning paraffin deposits from underground transmission pipelines, where the system can be utilized at any point along the pipeline which is cost effective, and which eliminates the problem of paraffin build-up at any point on the pipeline.

SUMMARY OF THE PRESENT INVENTION

The apparatus and system of the present invention, solves the problem in the art in a simple and straight forward manner. What is provided is a system for removing the build-up of paraffin or aspheltine from a pipeline, including a combination heat in order to melt the paraffin, jetting or turbulent action for removal of the contaminant from the pipe wall, and to maintain a turbulent action in order to keep any particles in suspension. In order to carry out this system, what is provided is a special pipeline pig known by "Jetstream". The pig comprises a steel body supported by bi-directional urethane disks which are separated by either steel or urethane spacers. The rear disks are separated by a magnetic circuit encapsulated in urethane, the function of which is to insure detectability of the pig from the outside of the pipeline. The pig further comprises two pole plates utilized in conjunction with the magnets in order to guide the flux to the wall of the pipeline. Such a field may be utilized for activating the magnetic pig passage indicators for finding its exact position by a fluxgate gradiometer.

The pig further comprises a nose chamber having a pressure relief valve which can be set to activate at a predetermined delta "P" (pressure) factor. The nose further comprises a plurality of drilled jetting nozzles extending through the nose, so that under pressure a fluid or the like may be jetted through the plurality of nozzles, the nozzles aiming the flow of fluid along the entire wall of the pipeline as the pig is moved therethrough. There is further included a means for stopping the pig at the area of wax formation, this means may include mechanical brakes activated by external electromagnetic or sonic mediums (signals); hydraulically by introducing back pressure into the system; or mechanically by lifting the pig with urethane disks and spacers which cause sufficient drag so that the pig's progress is impeded by the wax formation. There is further provided a means for introducing chemical components in the vicinity of the pig in order to generate a heat reaction which takes place when the first chemical becomes contaminated with the second chemical. For example, utilizing hydrochloric acid acting as the first chemical and anhydrous ammonia as the second chemical, a high temperature is developed at the point where the two chemicals react as they come into contact with one another.

In summary, the wax/aspheltines removal can be achieved by inserting a batch of hydrochloric acid quantity and strength to be ascertained for each particular use;

Following the loading of the HCL, the "Jetstream" pig is then propelled forward by a quantity of Anhydrous Ammonia, which is followed by an agent such as Xylene for eliminating the possibility of crystallization. In effect, the pig has separated the batch of HCL from the Anhydrous Ammonia. Next, when the batch or system reaches the point where build-up of wax/aspheltine has begun, the pig will become impeded, and the Delta "P" (pressure) factor will increase until it reaches the predetermined factor where the pressure release valve becomes activated, allowing the Anhydrous Ammonia to jet through the pig's nozzles at high velocity. The force factor plus the thermal reaction with the HCL will cause the contaminate wax build-up to be released from the pipeline wall. The turbulent flow created will cause the melted contaminate to either blend with the product or be held in suspension. Thus, the pig can be moved along in the pipeline at normal speed after this cleaning has taken place. Further, due to the pig's magnetic circuit, the pig can be traced at all times and in the event of a problem, where the operators are forced to back off intrusive contaminate, the actual location can be determined.

Therefore, it is the principal object of the present invention to provide a system which includes a combination of a "Jetstream" pig, and chemicals such as HCL, Anhydrous Ammonia and Xylene, for removing wax deposits from the internal wall of an oil pipeline either on land or subsea operations;

It is a further object of the present invention to provide a "Jetstream" pig in a system, which can be identified in the event that it becomes obstructed and the amount of chemical compound can be identified as to quantity in the process;

It is a further object of the present invention to provide a combination of correct chemical compounds in order to produce an exothermic reaction coupled with a "Jetstream" pig for removal of wax and maintaining a continuous thermal reaction during the wax removal in a pipeline;

It is a further object of the present invention to provide an improved pig which may be controlled at any desired section of the pipeline and allow jetting operations until the area is cleared;

It is a further object of the present invention to provide an improved "Jetstream" pig, which may be moved along the internal bore of a pipeline under pressure, and when the pig reaches the point of wax deposit, a pressurized fluid such as hot water or steam would activate the pressure release valve, allowing the steam or hot water to exit the jetting nozzles of the pig in order to soften and dislodge the wax deposit as the pig moves along the pipeline;

It is a further object of the present invention to provide a "Jetstream" pig which may include a circular brush along the wall of the pig for cleaning any wax deposits which may have been loosened by fluid flow through jetting nozzles of the pig as the pig is moved along the internal bore of the pipeline under pressure.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

DETAILED DESCRIPTION OF THE PREFERRED EMBODIMENT

Figure 1:
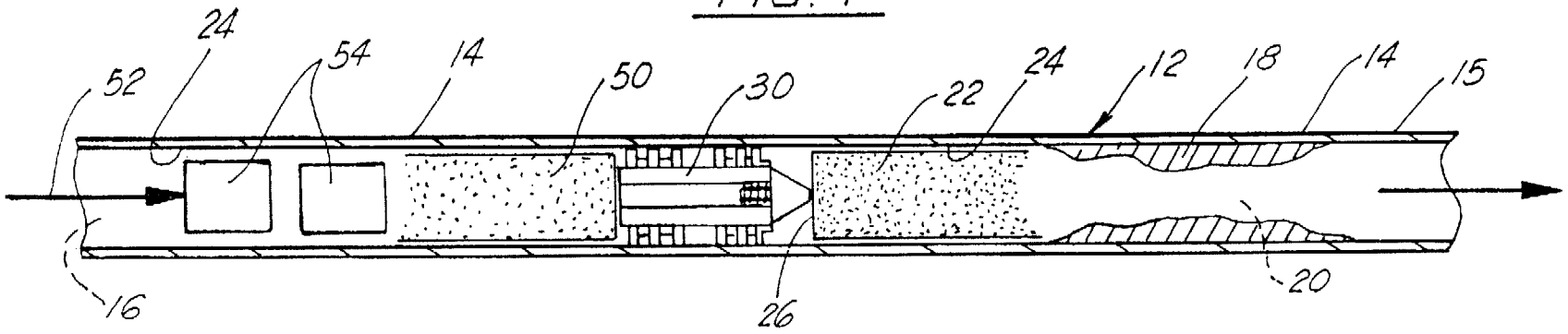
FIGS. 1 and 2 are overall cross-sectional views of the pipeline utilizing the system of the present invention.

FIGS. 1–5 illustrate the preferred embodiment of the method and system of the present invention, and the improved "Jetstream" pig utilized therein. As seen in FIG. 1, there is illustrated in cross-sectional view a continuous pipeline 12, of the type utilizing a plurality of sections of pipe 14, a wall 15, having a flowbore 16 therethrough, for defining the continuous pipeline 12 between points, for transporting materials such as crude oil, gas, chemicals, or slurries of the same, through the pipeline 12. As illustrated, the pipeline 12 includes a paraffin or aspheltine obstruction section 18, which in cross-section, provides a restricted passageway 20 through that portion of the pipeline as seen in FIG. 1. Therefore, the system of the present invention will be utilized to clean that obstruction 18 from the pipeline 12 as will be described further.

As seen in FIG. 1, there is illustrated a first plug or mass of chemical compound 22, which is formed along the inner surface 24 of pipeline 12. As illustrated, the first compound 22, preferably Hydrochloric acid or the like, is positioned at a point 26 forward of an improved "Jetstream" pig 30, as illustrated in FIG. 1. "Jetstream" pig 30, as will be more fully described further, is seen positioned within the pipeline 12, and occupying the entire bore 16 of the pipeline 12. To the rear of pig 30, is a second chemical compound 50, preferably Anhydrous Ammonia, which is being forced from the pressure in the direction of arrow 52 as illustrated in FIG. 1. Further, there is a third section of chemical compound 54, preferably Xylene or the like, which would prevent the crystalization from occurring after the reaction takes place in this particular embodiment of the process.

Figure 3:
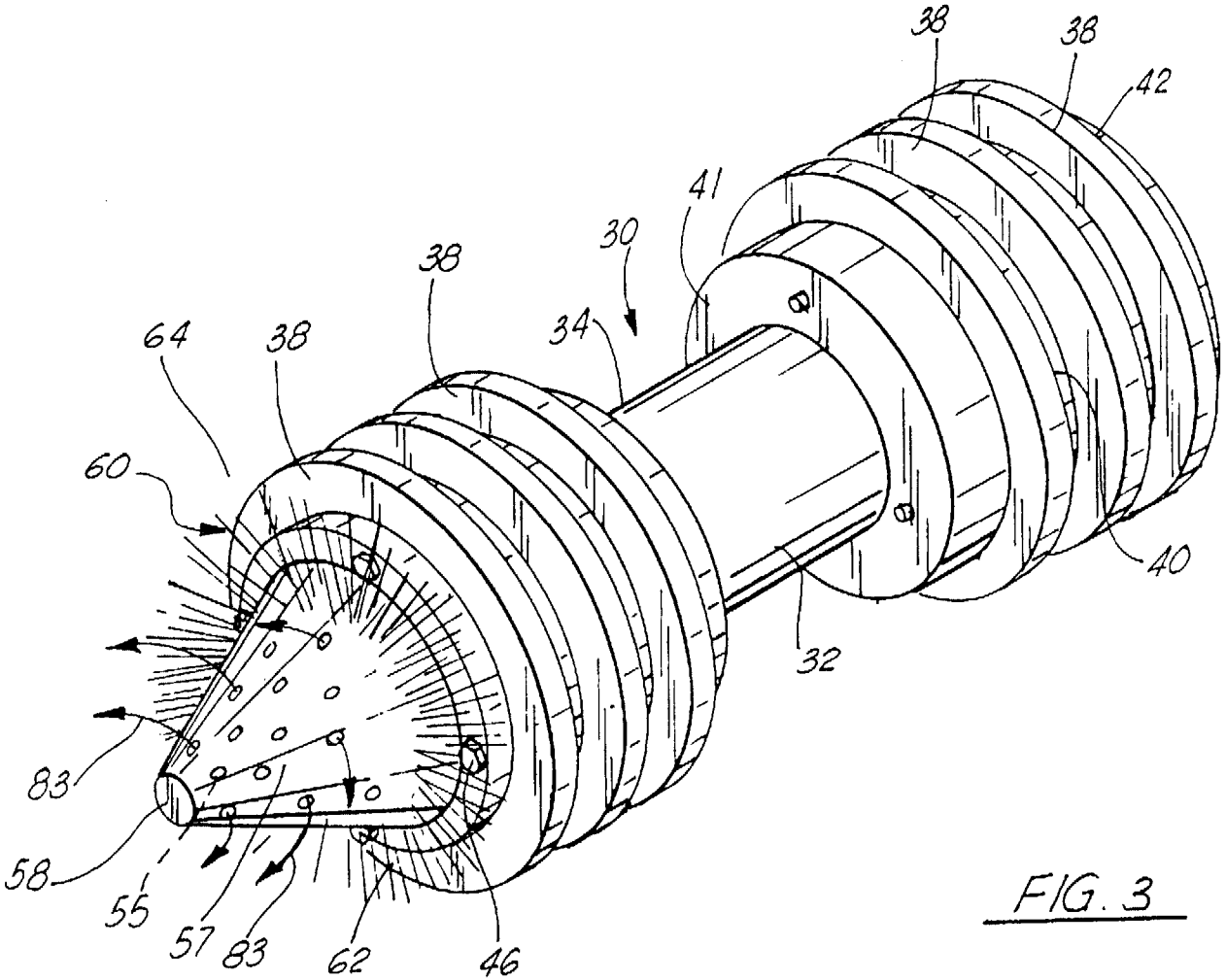
FIG. 3 illustrates an overall view of the improved "Jetstream" pig utilized in the system and method of the present invention.
Figure 4:
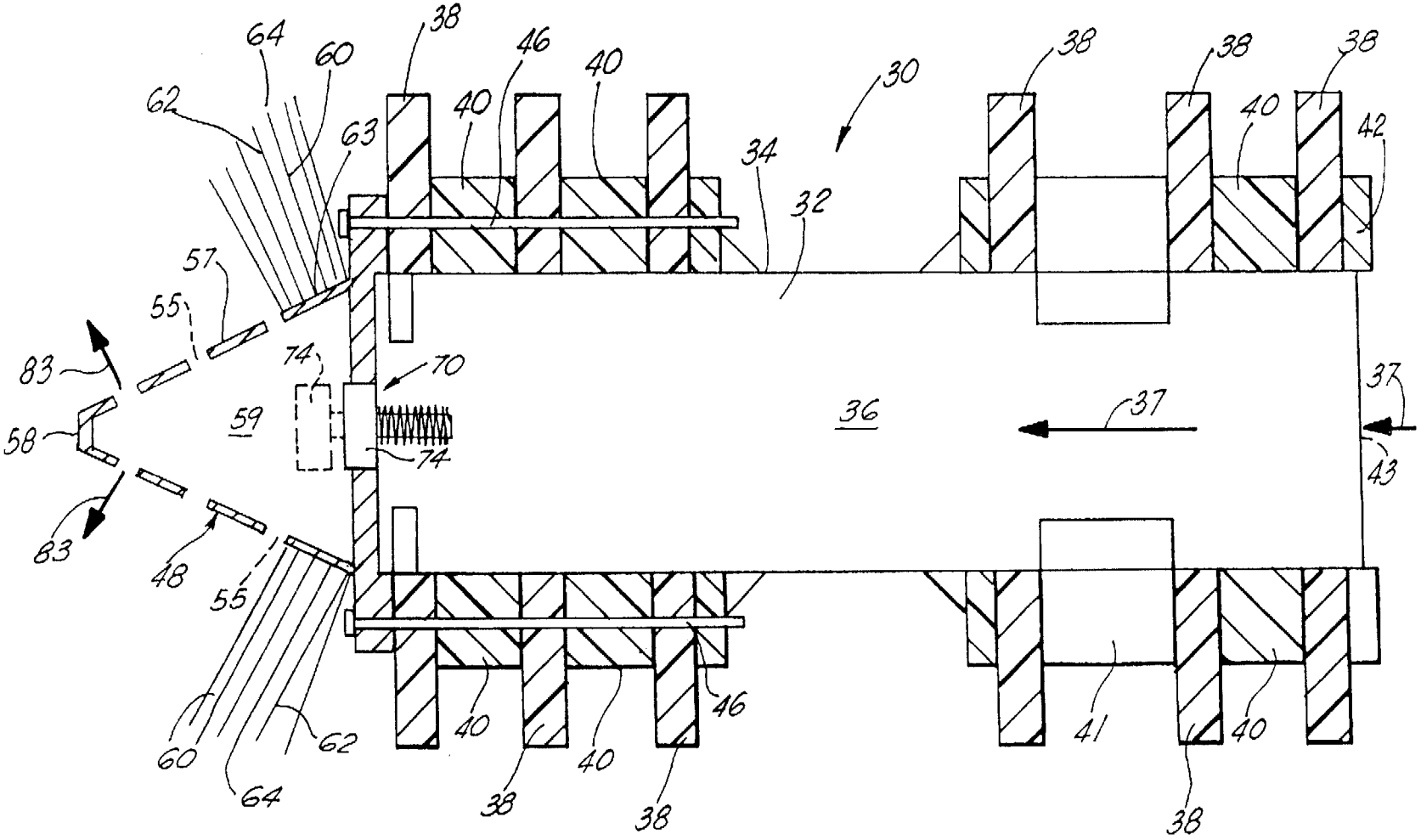
FIG. 4 is a cross-sectional view of the "Jetstream" pig utilized in the system and method of the present invention.

Prior to turning further in the process, reference is made to FIGS. 3 and 4 which illustrate the improved "Jetstream" pig 30, utilized in the process. As illustrated in FIGS. 3 and 4, "Jetstream" pig 30 comprises a principal pig body 32, having a continuous wall portion 34, with an internal chamber 36, therein as seen in FIG. 4. "Jetstream" pig 30 further comprises a plurality of bi-directional urethane disks 38, as illustrated six disks, which are separated by either steel or urethane spacers 40. The plurality of urethane disks 38, extend across the bore 16 of the pipeline 12, so that they make contact with the inner surface 24 of the pipeline 12, as the pig 30 is moved therethrough under pressure. There is further provided a magnetic circuit 41, encapsulated within urethane spacers 40, to the rear portion 42 of the pig 30, for ensuring that the pig 30 can be detected from the outside of the pipeline 12, should its position have to be located within the pipeline. In the use of this type of magnetic circuit, which is known in the art, two pole plates are utilized in conjunction with magnets, in order to guide the flux to the wall of the pipeline. Such a field may be utilized to activate magnetic pig passage indicators and the exact position may be located by a fluxgate gradiometer, again which is known in the art.

Further, the construction of the pig 30, as seen in side view, illustrates that inner chamber 36 within pig 30 extends the length of pig body 32, and is open ended at its rear end 43 of the pig 30 for allowing fluid or the like to flow within the chamber 36, in the direction of arrow 37. The forward portion 44 of pig 30, includes a plate 45, which is secured to the plurality of urethane disks 38, via extended rods 46, as illustrated in FIG. 4. The pig 30 further includes a forward nose cone portion 48, which is cone shaped having a continuous conical side wall 57, terminating in a truncated tip portion 58, and defining an inner chamber 59 within the nose cone 48. Nose cone 48 includes a plurality of jetting ports or nozzles 55 through which fluid may flow therethrough as will be described further. As further illustrated, this particular embodiment of the pig 30, is illustrated in FIGS. 3 and 4, includes a circular brush member 60, which includes a plurality of bristles 62, extending outward there from at the base 63 of the nose cone 48, with the ends 64 of the bristles 62, extending outward substantially the width of the urethane plates 38, so that the bristles 62 make contact with the inner surface 24 of the pipeline 12 as the pig 30 is moved therethrough. As further illustrated in pig 30, there is included a pressure valve 70, which includes a sealing member 74, which is maintained in a sealing position by a spring member 76 on its rear portion. When fluid 80 under pressure has entered the chamber 36 of pig 30, as seen by arrow 37, the build-up of pressure will reach a certain amount i.e. a predetermined Delta P (pressure) factor, at which time the sealing member 74, of valve 70, will move forward as seen in phantom view in FIG. 4, allowing fluid to flow into the inner chamber 59 of nose cone 48, and out of the jetting nozzles 55 as seen in the direction of arrows 83 in FIG. 3. This usually occurs in the process when the pig 30 has met the paraffin obstruction 18 along the wall 15 of the pipeline 12, and its forward progress is impeded. Therefore, as the forward progress would be impeded, the pressure which is moving along in the pipeline 12 as seen in FIG. 1, builds up in the bore 42 of the pig 30 and therefore activates the valve 70 as was described earlier.

Figure 2:
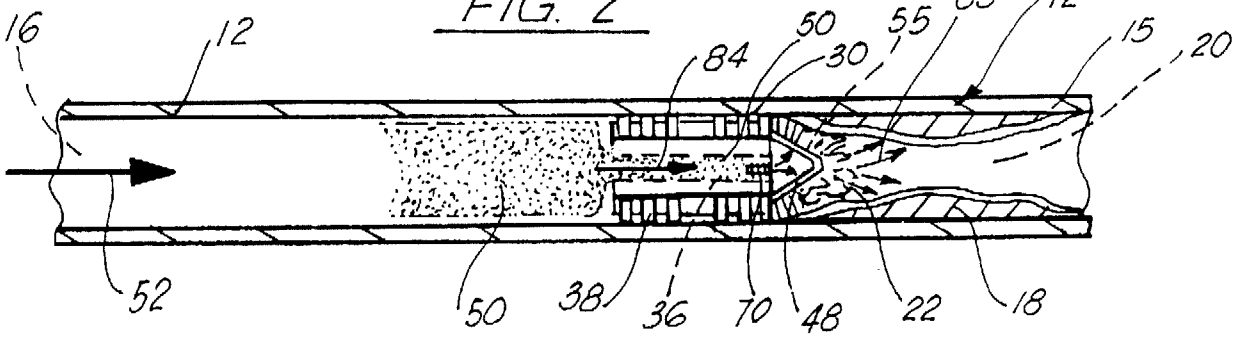

Returning now to the process, reference is again made to FIG. 1 where the pig 30 is seen moving forward and having met with an obstruction of paraffin 18 as was described earlier. Turning now to FIG. 2, because the pig 30 is obstructed, its progress is impeded, and the pressure as seen by arrow 84 in FIG. 2 has forced the second compound 50 (Anhydrous Ammonia), to enter the bore 42 of pig 30, and to activate the valve 70 allowing the Anhydrous Ammonia to move into the nose cone 48 and out of the jetting nozzles 55 in nose cone 40 as seen in FIG. 2. Upon this happening, the Anhydrous Ammonia 50, encountering the Hydrochloric acid 22 will create an exothermic reaction and a tremendous amount of heat will be the result, thus melting or softening the build-up of paraffin 18 as seen in FIG. 4. When the paraffin has been sufficiently softened or melted, the pressure which is continuing to be put upon the rear of pig 30 will allow the pig to then resume moving forward, scraping the paraffin 18 from the wall 15 of the pipeline 12, with the Xylene compound 54 maintaining the paraffin 18 in the liquid state as it moves along in the pipeline being pushed forward. It is foreseen that because the pig 30 has begun to move forward, after the obstruction 18 is cleared, the valve 70 will return to its normally sealed position, and the system will continue to move through the pipeline as was described earlier. It is also foreseen that should there be additional Hydrochloric acid 22 remaining forward of the pig 30, and additional Anhydrous Ammonia 50 remaining to the rear of the pig 30, as seen in FIG. 1, should another obstruction 18 of paraffin be encountered, then the same process will take place and again the exothermic reaction will clear the paraffin as was described earlier.

Figure 5:
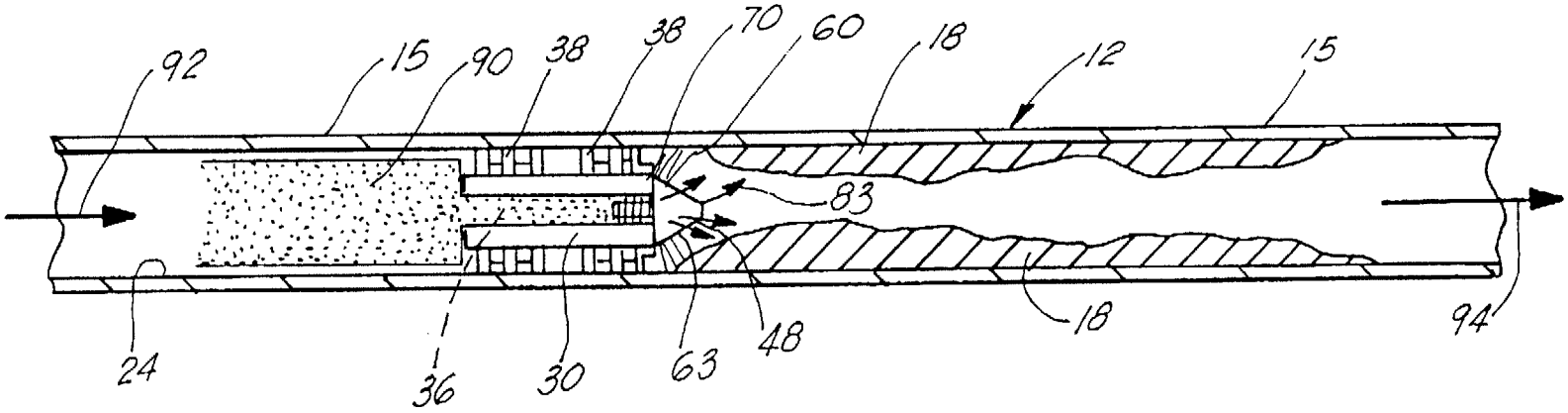
FIG. 5 is a cross-sectional view of the pipeline utilizing the "Jetstream" pig in a second embodiment in the system and method of the present invention.

Turning now to yet an additional embodiment of the system, the system could be used in a more simplified fashion as seen in FIG. 5. In this particular system, the pig 30 is utilized in effect by itself being pushed by a volume of pressurized fluid, such as water, which has been heated to a very high temperature i.e. above the temperature for melting paraffin 18. As seen in this particular FIGURE, the pig 30 is moving in the pipeline 12 with again the urethane spacers 38, making contact with the inner surface 24 of the pipeline wall 15, as it moves forward. Again, the pig 30 would be constructed in the same manner, having a valving member 70, for being activated should the pig 30 encounter any kind of obstruction 18. As seen in the FIGURE, the pig 30 has encountered an obstruction of paraffin 18, which again would slow the forward movement of the pig down. That being the case, the fluid, or heated water 90, to the rear of the pig 30, would, under pressure via arrow 92 then activate the valve member 70, which would allow the super heated water 90 to flow into the nose cone 48 of the pig 30 and out of the nozzles 58 of the nose cone 48 under great pressure, to make contact around the entire inner surface 24 of the pipeline wall 15, and to begin melting or softening the wax build-up as was described earlier. Upon this occurring, the brush member 60 on the base 63 of nose cone 48, would begin to move and scrape the paraffin build-up off of the wall 15 of the pipeline 12 and move it further. The heated water 90 would continue to be jetted out of the nose cone 48 of the pig 30 through the jetting nozzles 58, until such time as the paraffin 18 would be completely removed by the brush 60 s the pig moves forward (arrow 94). Again, as in the earlier embodiment, when the pig 30 begins to move forward, the valve 70 would be closed, and the pressure of the water 90 would simply move the pig 30 along the pipeline 12 until such time as it encountered another obstruction 18 along the inner surface 24 of the pipeline wall 15 wherein the process would repeat itself in cleaning the deposit off of the wall of the pipeline.

In both of the embodiments of the pig as was referred to earlier, although it has been referred to the cleaning of paraffin or wax on the wall of the pipeline, this pig could be utilized in the cleaning of the pipeline wall to clean any compound or accumulation of material on the inner surface of the pipeline to restrict the flowbore of the pipeline. The improved pig could be utilized with or without the brush system on the forward end of the pig and could be utilized only with the nose of the pig having the jetting nozzles thereupon. Further, the pig may be provided with a mechanical breaking system which would allow the pig to stop at any point along its travel within pipeline 12, so that the jetting action may take place whether it be the chemical jetting action or the heated water jetting action of both embodiments.

The following table lists the part numbers and part descriptions as used herein and in the drawings attached hereto.

PARTS LIST

| Description | Part No. |
|---|---|
| pipeline | 12 |
| pipe | 14 |
| wall | 15 |
| flowbore | 16 |
| paraffin obstruction | 18 |
| restricted passageway | 20 |
| first chemical compound | 22 |
| inner surface | 24 |
| point | 26 |
| jet stream pig | 30 |
| pig body | 32 |

-continued

PARTS LIST

| Description | Part No. |
|---|---|
| wall portion | 34 |
| internal chamber | 36 |
| arrow | 37 |
| urethane disks | 38 |
| urethane spacers | 40 |
| magnetic circuit | 41 |
| rear portion | 42 |
| rear end | 43 |
| forward portion | 44 |
| plate | 45 |
| extended rods | 46 |
| nose cone portion | 48 |
| second chemical compound | 50 |
| arrow | 52 |
| third chemical compound | 54 |
| jetting nozzles or ports | 55 |
| continuous conical side wall | 57 |
| truncated tip portion | 58 |
| inner chamber | 59 |
| brush member | 60 |
| bristles | 62 |
| nose cone base | 63 |
| bristle ends | 64 |
| pressure valve | 70 |
| sealing member | 74 |
| spring member | 76 |
| fluid | 80 |
| arrows | 82, 83, 84 |
| heated water | 90 |
| arrows | 92, 94 |

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A process for cleaning paraffin compounds from an inner surface of a pipeline wall for transporting liquid therethrough, comprising the following steps:

a) providing a first chemical component within the pipeline;

b) providing a pig to the rear of the first chemical component, the pig further comprising a forward end, a rear end, and a bore extending from the forward end to the rear end;

c) providing a second chemical component to the rear of the pig;

d) providing a greater pressure to the rear of the second chemical component than on the first chemical component in order to move the chemical components and the pig through the pipeline;

e) the pig encountering an obstruction of paraffin buildup along a wall of the pipeline;

f) increasing the pressure to the rear of the pig in order to activate a valving member, for forcing the chemical to the rear of the pig through fluid nozzles on the front end of the pig, so that at least a portion of the second chemical component mixes with the first chemical component at the front of the pig, and undergoes an exothermic reaction for loosening the paraffin obstruction at the front of the pig; and g) resuming the movement of the pig under pressure through the loose paraffin in order to clear the paraffin from the wall of the pipeline.

2. The process in claim 1, wherein the first chemical component is hydrochloric acid.

3. The process in claim 1, wherein the second chemical component is anhydrous ammonia.

4. The process in claim 1, further comprising the step of providing a third chemical component of xylene, positioned to the rear of the second chemical component, for preventing crystallization of the debris following the exothermic reaction.

5. The process in claim 1, further comprising the step of providing a brush means on the pig for removing paraffin remaining on the wall of the pipeline following the exothermic reaction.

6. The process in claim 1, further comprising the step of providing a means for sensing the location of the pig from the surface when the pig is travelling down the pipeline.

7. A method of cleaning paraffin which has been lodged on an inner surface of a pipeline wall, comprising the following steps:

a) providing a pig component, the pig component comprising;

i) a pig body having a forward end and an opening on a rear end, and a bore extending from the open rear end to the forward end;

ii) a plurality of spacers around the pig body, the spacers making contact with an inner surface of the pipeline wall;

iii) a conical portion positioned on forward end of the pig for receiving fluid flow under pressure from the bore in the pig body;

iv) a normally closed valving member positioned between the bore in the pig body and the conical portion, the valving member moveable to an open position to allow fluid to flow into the conical portion when fluid in the bore of the body exerts sufficient pressure to open the valving member; and v) a plurality of pressure nozzles on the conical portion wall for allowing the fluid under pressure to flow therethrough, the fluid flow directed to the paraffin obstruction on the inner wall of the pipeline;

b) moving the pig component through the pipeline under pressure;

c) encountering paraffin buildup within the bore of the pipeline so that the pig component is unable to move under the pressure;

d) increasing the pressure on the rear end of the pig body so as to activate the valving member to an open position for allowing the fluid to flow through the pressure nozzles for allowing the fluid under pressure to remove the paraffin from the wall of the pipeline.

8. The method in claim 7, wherein the fluid under pressure comprises water.

9. The method in claim 7, wherein the improved pig further comprises a means for sensing the location of the pig in the pipeline from the surface.

10. The method in claim 7, wherein the improved pig further comprises a brush means surrounding the conical portion for making contact with the wall of the pipeline as the pig moves through the pipeline for dislodging material, such as paraffin, from the pipeline wall.

11. An improved pig for moving through a pipeline bore for cleaning an inner surface of the wall of the pipeline, the pig comprising:

a) a pig body having a forward end and an opening on a rear end, and a bore extending from the open rear end to the forward end;

b) a plurality of spacers around the pig body, the spacers making contact with the inner surface of the pipeline wall;

c) a conical portion positioned on forward end of the pig for receiving fluid flow under pressure from the bore in the pig body;

d) a normally closed valving member positioned between the bore in the pig body and the conical portion, the valving member moveable to an open position to allow the fluid to flow into the conical portion when fluid in the bore of the body exerts sufficient pressure to open the valving member;

e) a plurality of pressure nozzles on the conical portion wall for allowing the fluid under pressure to flow therethrough, the fluid flow directed to the paraffin obstruction on the inner wall of the pipeline.

12. The improved pig in claim 11, further comprising a sensing means for allowing the location of the pig to be sensed from the earth's surface.

13. The improved pig in claim 11, further comprising a brush surrounding the conical portion of the pig, the brush making contact with the wall of the pipeline for dislodging paraffin from the wall which has been loosened by the pressurized fluid flow.

* * * * *